US010907788B2

(12) United States Patent
Ding

(10) Patent No.: US 10,907,788 B2
(45) Date of Patent: Feb. 2, 2021

(54) SWINGING ELECTRONIC CANDLE AND METHOD FOR ASSEMBLING THE SAME

(71) Applicant: Nantong Ya Tai Candle Arts & Crafts Co., Ltd., Jiangsu (CN)

(72) Inventor: Yingqi Ding, Jiangsu (CN)

(73) Assignee: NANTONG YA TAI CANDLE ARTS & CRAFTS CO., LTD., Jiangsu (CN)

( * ) Notice: Subject to any disclaimer, the term of this patent is extended or adjusted under 35 U.S.C. 154(b) by 0 days.

(21) Appl. No.: 16/370,883

(22) Filed: Mar. 30, 2019

(65) Prior Publication Data

US 2019/0226653 A1 Jul. 25, 2019

Related U.S. Application Data

(63) Continuation-in-part of application No. PCT/CN2017/114629, filed on Dec. 5, 2017.

(30) Foreign Application Priority Data

Aug. 9, 2017 (CN) ..... 2017 2 0994920 U

(51) Int. Cl.
*F21S 10/04* (2006.01)
*F21S 6/00* (2006.01)
(Continued)

(52) U.S. Cl.
CPC ..... *F21S 10/046* (2013.01); *F21S 6/001* (2013.01); *F21S 9/02* (2013.01); *F21Y 2115/10* (2016.08)

(58) Field of Classification Search
CPC ..... F21S 10/04; F21S 6/001; F21S 10/046
See application file for complete search history.

(56) References Cited

U.S. PATENT DOCUMENTS

2006/0034100 A1* 2/2006 Schnuckle ..... G02B 6/0008 362/161
2008/0151534 A1* 6/2008 Lin ..... F21S 10/04 362/191
(Continued)

FOREIGN PATENT DOCUMENTS

CN 202747231 U 2/2013
CN 103574487 A 2/2014
(Continued)

OTHER PUBLICATIONS

International search report of PCT Patent Application No. PCT/CN2017/114629 dated Mar. 27, 2018.

*Primary Examiner* — Eric T Eide
(74) *Attorney, Agent, or Firm* — Innovation Capital Law Group, LLP; Vic Lin

(57) ABSTRACT

A swinging electronic candle, includes: a lamp cap assembly, including: a fixing base, a flame crown support base and a flame crown, wherein the fixing base is provided with a first accommodation space, the flame crown support base is located in the first accommodation space and is fixedly or movably connected to the fixing base, and the flame crown is movably connected to the flame crown support base, such that when the air flow reaches a predetermined speed, the flame crown can swing in the air, and thus with the swinging electronic candle described above, it is possible to simulate a situation in which the flame sways with wind when a real candle is burning. A method for assembling a swinging electronic candle is also disclosed.

9 Claims, 7 Drawing Sheets

(51) Int. Cl.
*F21Y 115/10* (2016.01)
*F21S 9/02* (2006.01)

(56) References Cited

U.S. PATENT DOCUMENTS

| | | | | |
|---|---|---|---|---|
| 2015/0036348 | A1* | 2/2015 | Dong | F21S 9/02 362/293 |
| 2015/0308643 | A1* | 10/2015 | Huang | F21S 10/046 362/157 |
| 2015/0338042 | A1* | 11/2015 | Patton | H05B 47/19 348/742 |
| 2016/0146414 | A1* | 5/2016 | Dong | F21S 6/001 362/232 |
| 2016/0290579 | A1 | 10/2016 | Au et al. | |
| 2017/0159901 | A1* | 6/2017 | Li | F21S 10/046 |
| 2018/0283633 | A1* | 10/2018 | Roberts | F21S 6/001 |

FOREIGN PATENT DOCUMENTS

| | | | |
|---|---|---|---|
| CN | 204534387 | U | 8/2015 |
| CN | 106090819 | A | 11/2016 |
| CN | 205842506 | U | 12/2016 |
| CN | 206280913 | U | 6/2017 |

* cited by examiner

SWINGING ELECTRONIC CANDLE AND METHOD FOR ASSEMBLING THE SAME

CROSS REFERENCE TO RELATED APPLICATIONS

The present application is a Continuation-In-Part Application of PCT Application No. PCT/CN2017/114629 filed on Dec. 5, 2017, which claims the benefit of Chinese Patent Application No. 201720994920.9 filed on Aug. 9, 2017. All the above are hereby incorporated by reference.

TECHNICAL FIELD

The present invention relates to the technical field of electronics, and in particular to a swinging electronic candle. The present invention also relates to a method for assembling a swinging electronic candle.

BACKGROUND ART

The existing candles are mainly ignition-burning candles with low cost, but there are potential safety hazards in use, and they are not environmentally friendly.

Electronic candles have the advantages of being environmentally friendly, energy-saving, safe, and convenient, so they are being liked by more and more people.

The inventor of the present application has found in a long-term study that the existing electronic candles cannot present the effect of a real candle swaying with wind when burning, and the simulation effect is not strong.

SUMMARY OF THE INVENTION

The technical problem mainly solved by the present invention is to provide a swinging electronic candle capable of simulating a situation in which the flame sways with wind when a real candle is burning.

In order to solve the above technical problem, a technical solution adopted by the present invention is to: provide a swinging electronic candle, comprising:

a lamp cap assembly, comprising: a fixing base, a flame crown support base and a flame crown, wherein the fixing base is provided with a first accommodation space, and the flame crown support base is located in the first accommodation space and is fixedly or movably connected to the fixing base, and the flame crown is movably connected to the flame crown support base, such that when the air flow reaches a predetermined speed, the flame crown can swing in the air. The technical solution also provides a method for assembling a swinging electronic candle, including suspending the flame crown support base on a lower housing of the fixing base, suspending the flame crown on the flame crown support base, and clamping an upper housing of the fixing base to the lower housing of the fixing base.

The beneficial effects of the present invention are as follows: Different from the prior art, the swinging electronic candle in the present invention comprises: a lamp cap assembly, comprising: a fixing base, a flame crown support base and a flame crown, wherein the fixing base is provided with a first accommodation space, the flame crown support base is located in the first accommodation space and is fixedly or movably connected to the fixing base, and the flame crown is movably connected to the flame crown support base, such that when the air flow reaches a predetermined speed, the flame crown can swing in the air, and thus with the swinging electronic candle described above, it is possible to simulate a situation in which the flame sways with wind when a real candle is burning, thereby enhancing simulation effect.

BRIEF DESCRIPTION OF THE DRAWINGS

In order to more clearly illustrate the technical solutions in the embodiments of the present invention, the drawings used in the description of the embodiments will be briefly described below. Obviously, the drawings in the following description are only some embodiments of the present invention, and a person skilled in the art can obtain other drawings according to the drawings without any creative work. In the drawings.

DETAILED DESCRIPTION OF EMBODIMENTS

The technical solutions of the embodiments of the present invention will be clearly and completely described below in conjunction with the accompanying drawings in the embodiments of the present invention; and obviously, the embodiments described are merely some of, rather than all, the embodiments of the present invention. Based on the embodiments of the present invention, the other embodiments obtained by a person skilled in the art under the premise of not involving an inventive effort all fall within the scope of protection of the present invention.

Figure 1:
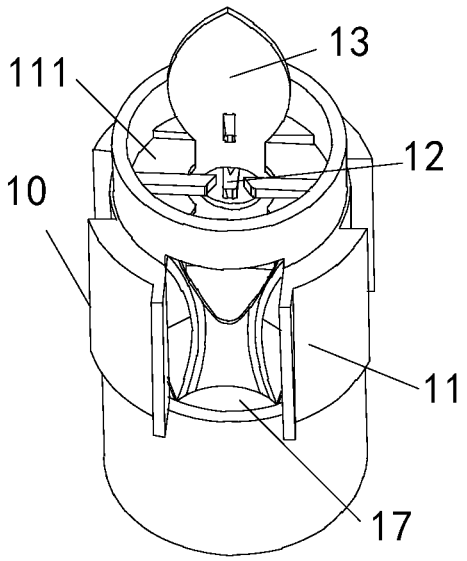
FIG. 1 is a schematic structural view of an embodiment of a swinging electronic candle of the present invention.
Figure 2:
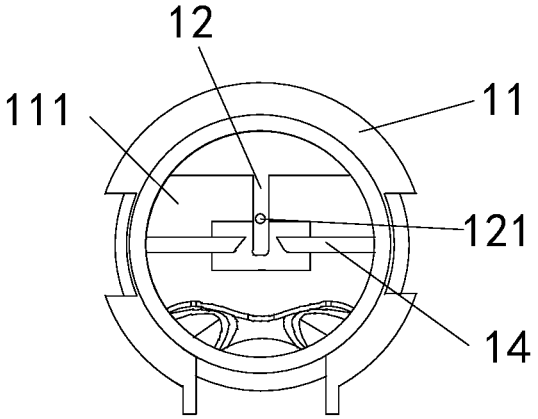
FIG. 2 is a schematic top view of the swinging electronic candle of FIG. 1.

Referring to FIGS. 1-2, FIG. 1 is a schematic structural view of an embodiment of a swinging electronic candle of the present invention, and FIG. 2 is a schematic top view of the swinging electronic candle of FIG. 1.

The swinging electronic candle comprises a lamp cap assembly 10, the lamp cap assembly 10 specifically comprising: a fixing base 11, a flame crown support base 12 and a flame crown 13, wherein the fixing base 11 is provided with a first accommodation space 111, the flame crown support base 12 is located in the first accommodation space 111 and is fixedly connected to the fixing base 11, and the flame crown 13 is movably connected to the flame crown support base 12, such that when the air flow reaches a predetermined speed, the flame crown 13 can swing in the air, and thus it is possible to simulate a situation in which the flame sways with wind when a real candle is burning.

The predetermined speed may be determined according to a specific situation, when the flame crown 13 is light, the predetermined speed is slow, and when the flame crown 13 is heavy, the predetermined speed is fast. Specifically, the flame crown 13 can be controlled to swing in the air by the designer through adjusting the mass of the flame crown 13 according to the customer's requirements, when the air flow reaches the predetermined speed.

Figure 3:
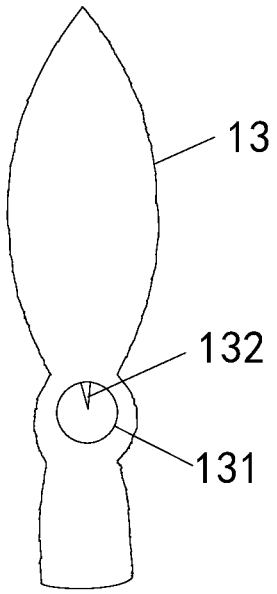
FIG. 3 is a schematic structural view of a flame crown in the swinging electronic candle of FIG. 1.

Referring to FIG. 3, FIG. 3 is a schematic structural view of the flame crown of FIG. 1, wherein a through hole 131 is provide in the flame crown 13, and a protrusion 132 facing the through hole 131 is provided on the top of the through hole 131.

Continue to refer to FIG. 2, in this embodiment, the flame crown support base 12 is a first crossbar 12 protruding from an inner wall of the fixing base 11, and a groove 121 is provided in an upper surface of the first crossbar 12, the diameter of the groove 121 being larger than that of the protrusion 132, optionally, the groove 121 is curved or circular.

The flame crown 13 passes through the first crossbar 12 through the through hole 131 and is supported on the groove 121 by the protrusion 132, and at this time, the flame crown 13 is not in contact with the first crossbar 12 except for the protrusion 132, such that when the air flow reaches a predetermined speed, the flame crown 13 can swing in the air.

Optionally, in this embodiment, in order to ensure that the flame crown 13 will not disengage from the first crossbar 12 during swinging, in a direction perpendicular to the extension of the first crossbar 12, at least one second crossbar 14 protrudes from the inner wall of the fixing base 11, the length of the second crossbar 14 at least ensuring that the flame crown 13 will not disengage from the first crossbar 12 when swinging, optionally, in this embodiment, the number of the second crossbar 14 is 2.

Figure 4:
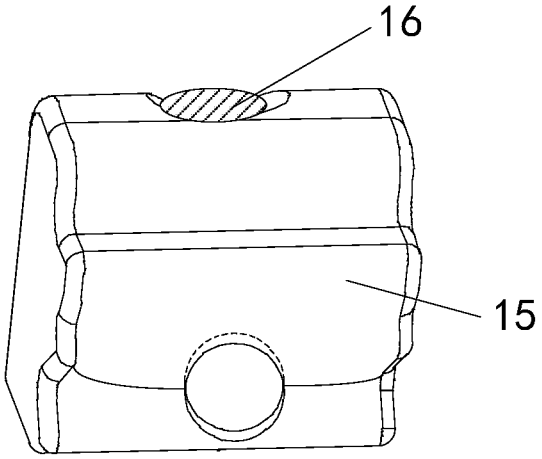
FIG. 4 is a schematic view of the combination of the first lamp bead and the first lamp holder in the embodiment of FIG. 1.

Optionally, in this embodiment, the swinging electronic candle further comprises: a first lamp holder 15 and a first lamp bead 16, the first lamp bead 16 being mounted on the first lamp holder 15, wherein a schematic view of the combination of the first lamp holder 15 and the first lamp bead 16 is as shown in FIG. 4. Continue to refer to FIG. 1, the fixing base 11 is provided with a first opening 17 on a portion of the inner wall opposite to the first crossbar 12, and the first lamp holder 15 is embedded in the first opening 17, such that light emitted by the first lamp bead 16 illuminates on the flame crown 13 or reflected by a reflector (not shown) onto the flame crown 13.

Figure 5:
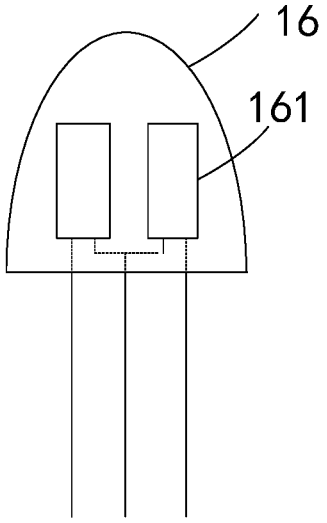
FIG. 5 is a schematic structural view of the first lamp bead of FIG. 4.

Referring to FIG. 5, FIG. 5 is a schematic structural view of the first lamp bead 16 in this embodiment.

Optionally, in order to enhance the simulation effect, the first lamp bead 16 comprises at least two light-emitting devices 161, the at least two light-emitting devices 161 alternately emitting light to produce a flickering effect, wherein the light-emitting devices 161 are light-emitting diodes.

Specifically, the color of the light emitted by at least one of the at least two light-emitting devices 161 is changing; or, the intensity of the light emitted by at least one of the at least two light-emitting devices 161 is changing.

Of course, in other embodiments, the first lamp bead 16 may also comprise only one light-emitting device 161, and the number of the light-emitting devices 161 in the first lamp bead 16 is not limited herein.

Figure 6:
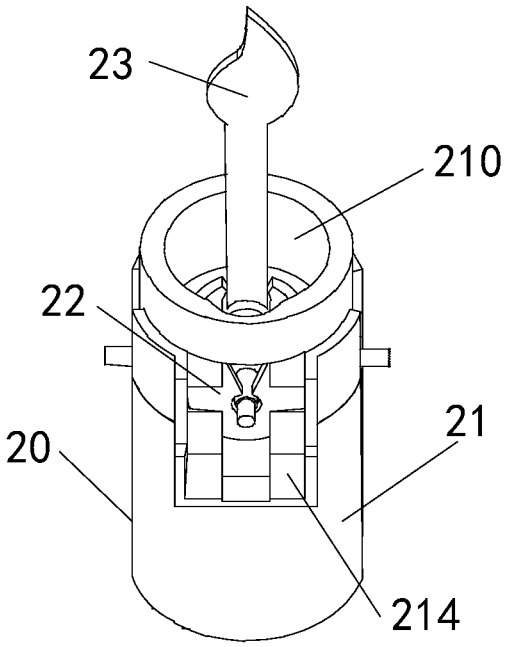
FIG. 6 is a schematic structural view of another embodiment of a swinging electronic candle of the present invention.

Referring to FIG. 6, FIG. 6 is a schematic structural view of another embodiment of a swinging electronic candle of the present invention.

The swinging electronic candle comprises a lamp cap assembly 20, the lamp cap assembly 20 specifically comprising: a fixing base 21, a flame crown support base 22 and a flame crown 23, wherein the fixing base 21 is provided with a first accommodation space 210, and the flame crown support base 22 is located in the first accommodation space 210 and is movably connected to the fixing base 21, the flame crown 23 is movably connected to the flame crown support base 22, such that when the air flow reaches a predetermined speed, the flame crown 23 can swing in the air, and thus it is possible to simulate a situation in which the flame sways with wind when a real candle is burning.

Figure 7A:
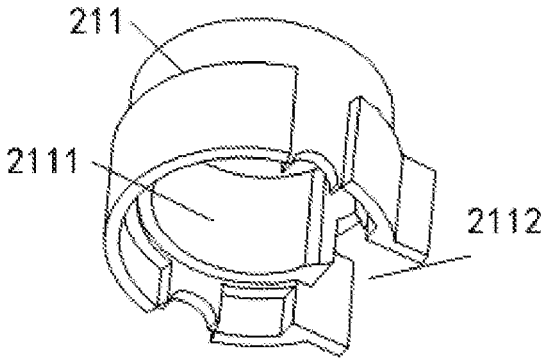
FIG. 7*a* is a structural schematic view of a first portion of the fixing base of the swinging electronic candle of FIG. 6.
Figure 7B:
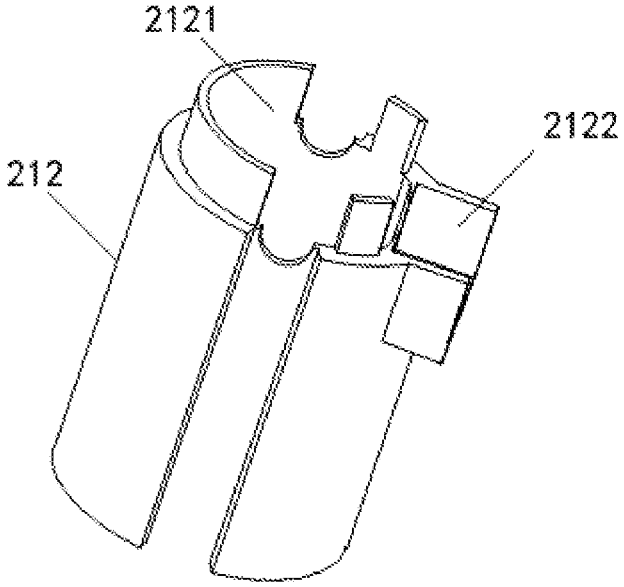
FIG. 7*b* is a structural schematic view of a second portion of the fixing base of the swinging electronic candle of FIG. 6.
Figure 7C:
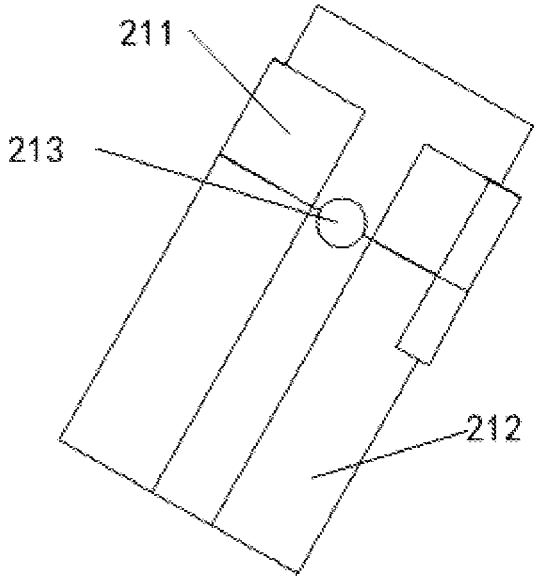
FIG. 7*c* is a side view of the fixing base of the swinging electronic candle of FIG. 6.

Referring to FIGS. 7*a-c*, FIGS. 7*a-c* are schematic structural views of the fixing base in this embodiment.

The fixing base 21 comprises an upper housing 211 (shown in FIG. 7*a*) and a lower housing 212 (shown in FIG. 7*b*). The upper housing 211 is provided with a first accommodation sub-space 2111, the lower housing 212 is provided with a second accommodation sub-space 2121, and the upper housing 211 and the lower housing 212 are clamped to each other (as shown in FIG. 7*c*), such that the first accommodation sub-space 2111 and the second accommodation sub-space 2121 are connected to form the first accommodation space 210.

Optionally, a lower edge of the upper housing 211 is provided with a downwardly facing and outwardly flanged notch 2112, and an upper edge of the lower housing 212 is provided with a upwardly facing and outwardly flanged notch 2122, and when the upper housing 211 is clamped to the lower housing 212, the downwardly facing and outwardly flanged notch 2112 and the upwardly facing and outwardly flanged notch 2122 align with each other to form a second opening 214.

Optionally, in this embodiment, the swinging electronic candle further comprises: a second lamp holder (not shown) and a second lamp bead (not shown), the second lamp holder being embedded in the second opening 214, such that light emitted by the second lamp bead illuminates on the flame crown 23 or reflected by a reflector (not shown) onto the flame crown 23.

The structures of the second lamp bead and the second lamp holder are the same as or similar to those of the first lamp bead 16 and the first lamp base 15 in the above embodiment, respectively. See the above embodiment for details which will not described herein again.

Continue referring to FIG. 7*c*, two opposite through holes 213 are formed at a clamp joint of the upper housing 211 and the lower housing 212, and the flame crown support base 22 is suspended on the fixing base 21 through the two opposite via through holes 213, wherein the second opening 214 is disposed in a direction perpendicular to a line connecting the two through holes 213.

Figure 8A:
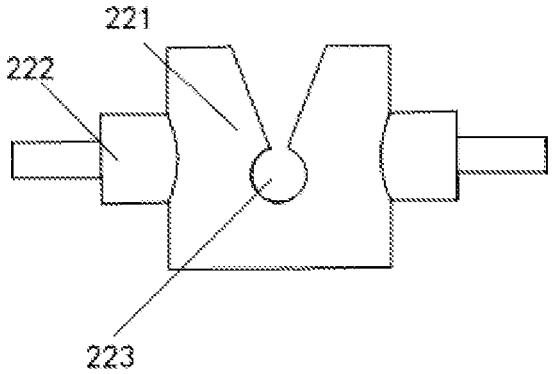
FIG. 8*a* is a front view of the flame crown support base in the swinging electronic candle of FIG. 6.
Figure 8B:
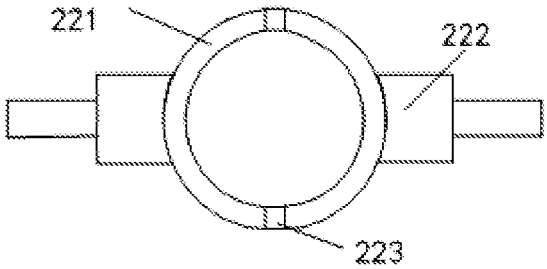
FIG. 8*b* is a top view of the flame crown support base in the swinging electronic candle of FIG. 6.

Referring to FIGS. 8*a* and 8*b*, FIG. 8*a* is a front view of the flame crown support base in the swinging electronic candle of FIG. 6; and FIG. 8*b* is a top view of the flame crown support base in the swinging electronic candle of FIG. 6.

The flame crown support base 22 comprises a hollow cylinder 221, an outer wall of the hollow cylinder 221 being provided with a first support part 222 that extends outwardly relative to the hollow cylinder, and two ends of the first support part 222 being respectively suspended in the two through holes 213 to be movably connected to the fixing base 21.

Moreover, in a direction perpendicular to the extension of the first support part 222, two opposite upwardly opening cut-outs 223 are provided in the hollow cylinder 221, and the flame crown 23 is suspended on the flame crown support base 22 through the two opposite upwardly opening cut-outs 223 to be movably connected to the flame crown support base 22.

Figure 9A:
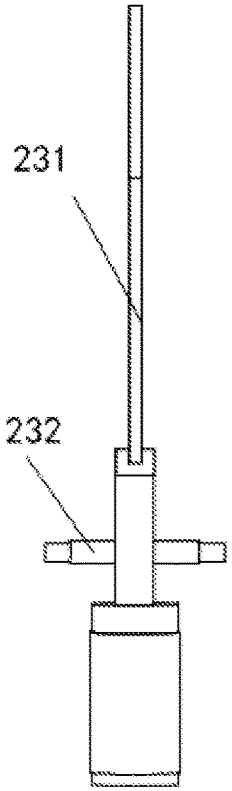
FIGS. 9*a* and 9*b* are respective schematic views of the structure of the flame crown in the swinging electronic candle of FIG. 6 from different perspective.
Figure 9B:
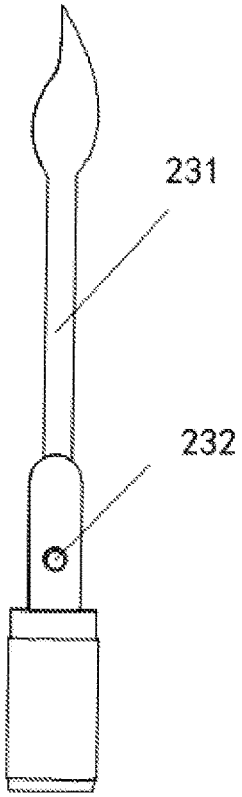

Referring to FIGS. 9*a* and 9*b*, FIGS. 9*a* and 9*b* are respective schematic views of the structure of the flame crown in the swinging electronic candle of FIG. 6 from different perspective.

The flame crown 23 comprises a flame crown body 231 and a second support part 232 extending outwardly relative to the flame crown body 231, and the flame crown 23 is suspended in the two opposite upwardly opening cut-outs 223 by means of the two ends of the second support part 232.

In the swinging electronic candle in this embodiment, when assembling, the flame crown support base 22 can be first suspended on the lower housing 212 of the fixing base 21 by placing two ends of the first support part 222 of the flame crown support base 22 in the two opposite upwardly facing notches of the lower housing 212 respectively, and then the flame crown 23 can be suspended on the flame crown support base 22 through the two opposite upwardly opening cut-outs 223 by placing two ends of the second support part 232 of the flame crown 23 in the two opposite upwardly opening cut-outs of the flame crown support base 22 respectively, and finally the upper housing 211 and the lower housing 212 of the fixing base 21 can be clamped to form the lamp cap assembly 20 in which the two opposite downwardly facing notches are in registration with the two opposite upwardly facing notches, and the downwardly facing and outwardly flanged notch is aligned with the upwardly facing and outwardly flanged notch to form an opening. When any of the elements of the lamp cap assembly 20 are damaged, the lamp cap assembly 20 can be disassembled to replace the damaged element.

Figure 10:
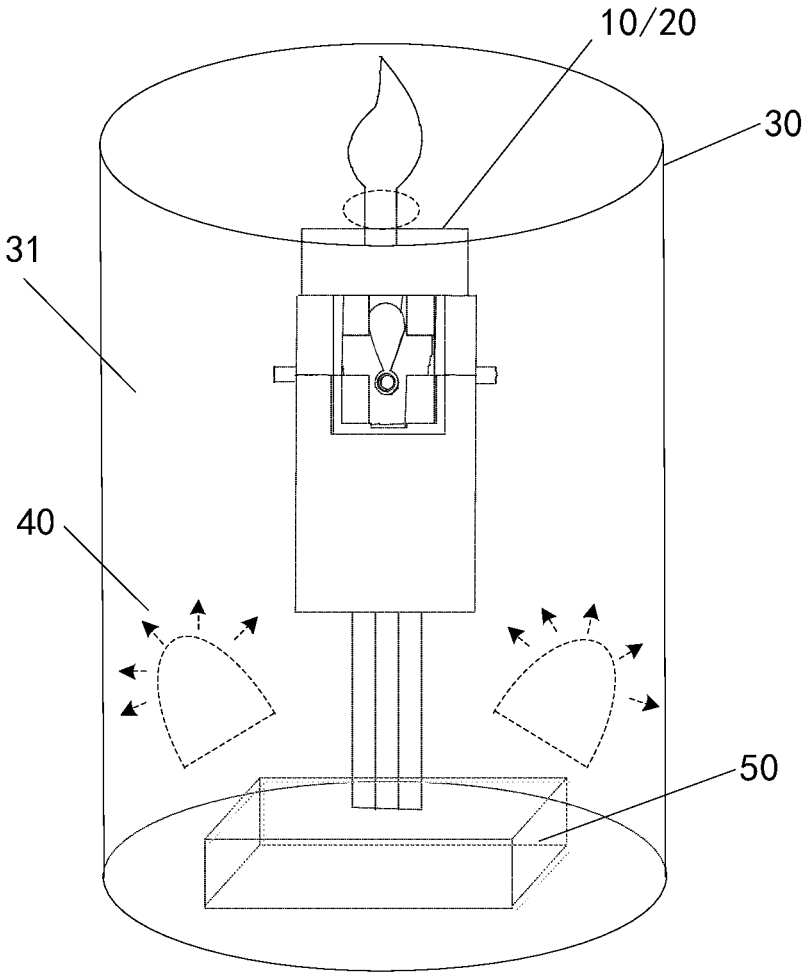
FIG. 10 is a schematic structural view of still another embodiment of the swinging electronic candle of the present invention.

Referring to FIG. 10, FIG. 10 is a schematic structural diagram of still another embodiment of a swinging electronic candle of the present invention, this swinging electronic candle further comprising: a candle body 30.

The candle body 30 is provided therein with a cavity 31, the lamp cap assembly 10 or the lamp cap assembly 20 is located in the cavity 31.

Moreover, in this embodiment, the swinging electronic candle further comprises at least one third lamp bead 40, the at least one third lamp bead 40 being located inside the cavity 31 to illuminate the candle body 30, wherein the third lamp bead 40 can emit light of any color, such as yellow, orange, red, or seven colors. Optionally, when the number of the third lamp bead 40 is 2, the third lamp beads 40 are disposed oppositely in the cavity 31.

Optionally, in this embodiment, the swinging electronic candle further comprises at least one control switch (not shown), wherein different control switches are connected to different third lamp beads 40 to control different third lamp beads 40 via the different control switches.

Optionally, in this embodiment, the swinging electronic candle further comprises a power source 50, wherein the power source 50 is used to supply power to the entire swinging electronic candle, and may be composed of a dry battery. The lamp cap assembly 10 or the lamp cap assembly 20 may be fixed, by a support rod, to a battery case in which the power source 50 is mounted.

Optionally, in this embodiment, the swinging electronic candle further comprises: an electronic control apparatus (not shown) for connecting to the first lamp bead 16 or the second lamp bead (not shown) or the at least one third lamp bead 40 to control same to emit light.

Different from the prior art, the swinging electronic candle in the present invention comprises: a lamp cap assembly, comprising: a fixing base, a flame crown support base and a flame crown, wherein the fixing base is provided with a first accommodation space, the flame crown support base is located in the first accommodation space and is fixedly or movably connected to the fixing base, and the flame crown is movably connected to the flame crown support base, such that when the air flow reaches a predetermined speed, the flame crown can swing in the air, and thus with the swinging electronic candle described above, it is possible to simulate a situation in which the flame sways with wind when a real candle is burning, thereby enhancing simulation effect.

The description above merely relates to the embodiments of the present invention, and is not intended to limit the scope of the invention. Any equivalent structure or equivalent process transformation made by using the contents of the description and drawings of the invention, or any direct or indirect application of the contents of the description and drawings of the invention in other related technical fields, is equally included in the patent protection scope of the invention.

The invention claimed is:

1. A swinging electronic candle, comprising:

a lamp cap assembly, comprising: a fixing base, a flame crown support base and a flame crown, wherein the fixing base is provided with a first accommodation space, and the flame crown support base is located in the first accommodation space and is fixedly or movably connected to the fixing base, and the flame crown is movably connected to the flame crown support base, such that when air flow reaches a predetermined speed, the flame crown swings in the air, the fixing base comprising an upper housing and a lower housing, wherein an upper edge of the lower housing is provided with two opposite upwardly facing notches, and a lower edge of the upper housing is provided with two opposite downwardly facing notches, the two opposite downwardly facing notches are in registration with the two opposite upwardly facing notches to form two opposite through holes, and the flame crown support base is suspended on the two opposite upwardly facing notches of the lower housing.

2. The swinging electronic candle according to claim 1, wherein, the upper housing is provided with a first accommodation sub-space, the lower housing is provided with a second accommodation sub-space, and the upper housing and the lower housing are clamped to each other, such that the first accommodation sub-space and the second accommodation sub-space are connected to form the first accommodation space.

3. The swinging electronic candle according to claim 2, wherein, the flame crown support base comprises a hollow cylinder, an outer wall of the hollow cylinder being provided with a first support part that extends outwardly relative to the hollow cylinder, and two ends of the first support part being respectively suspended in the two through holes; and in a direction perpendicular to the extension of the first support part, two opposite upwardly opening cut-outs are provided on an upper edge of the hollow cylinder, and the flame crown is suspended on the flame crown support base through the two opposite upwardly opening cut-outs.

4. The swinging electronic candle according to claim 3, wherein, the flame crown comprises a flame crown body and a second support part extending outwardly relative to the flame crown body, and the flame crown is suspended in the two opposite upwardly opening cut-outs by means of two ends of the second support part.

5. The swinging electronic candle according to claim 2, further comprising:

a first lamp holder and a first lamp bead, the first lamp bead being mounted on the first lamp holder, wherein in a direction perpendicular to a line connecting the two through holes, the lower edge of the upper housing is provided with a downwardly facing and outwardly flanged notch and the upper edge of the lower housing is provided with an upwardly facing and outwardly flanged notch, and when the upper housing is clamped to the lower housing, the downwardly facing and outwardly flanged notch and the upwardly facing and outwardly flanged notch align with each other to form a first opening, and the first lamp holder is embedded in the first opening, and light emitted by the first lamp bead illuminates the flame crown or is reflected by a reflector onto the flame crown.

6. The swinging electronic candle according to claim 1, further comprising:

a candle body which is provided therein with a cavity, the lamp cap assembly being located in the cavity; and at least one first lamp bead which is located inside the cavity to illuminate the candle body.

7. The swinging electronic candle according to claim 5, wherein, the first lamp bead comprises at least two light-emitting devices which alternately emit light to produce a flickering effect, wherein the light-emitting devices are light-emitting diodes;

the color of the light emitted by at least one of the at least two light-emitting devices is changing; or, the intensity of the light emitted by at least one of the at least two light-emitting devices is changing.

8. A method for assembling a swinging electronic candle, comprising:

providing a fixing base, a flame crown support base, a flame crown, and a lamp holder with a lamp bead, the fixing base comprising an upper housing and a lower housing, a lower edge of the upper housing being formed with two opposite downwardly facing notches and a downwardly facing and outwardly flanged notch, an upper edge of the lower housing being formed with two opposite upwardly facing notches and an upwardly facing and outwardly flanged notch, the flame crown support base comprising a hollow cylinder, two opposite upwardly opening cut-outs formed on an upper edge of the hollow cylinder, and a first support part extending outwardly relative to the hollow cylinder, the flame crown comprising a flame crown body and a second support part extending outwardly relative to the flame crown body, suspending the flame crown support base on the lower housing by placing two ends of the first support part of the flame crown support base in the two opposite upwardly facing notches of the lower housing respectively;

suspending the flame crown on the flame crown support base by placing two ends of the second support part of the flame crown in the two opposite upwardly opening cut-outs of the flame crown support base respectively; and clamping the upper housing to the lower housing in a position such that the two opposite downwardly facing notches are in registration with the two opposite upwardly facing notches, and the downwardly facing and outwardly flanged notch is aligned with the upwardly facing and outwardly flanged notch to form an opening.

9. The method for assembling a swinging electronic candle according to claim 8, further comprising:

embedding the lamp holder with the lamp bead in the opening in a position such that light emitted by the lamp bead illuminates the flame crown.

* * * * *